United States Patent [19]

Witt et al.

[11] 4,307,652

[45] Dec. 29, 1981

[54] MUZZLE-GUARD FOR FIREARMS

[76] Inventors: Leonard Witt; Mary L. Witt, both of 1923 N. Howe St., Apt. 2R, Chicago, Ill. 60614

[21] Appl. No.: 90,863

[22] Filed: Nov. 2, 1979

[51] Int. Cl.[3] ..... F41C 21/18

[52] U.S. Cl. ..... 89/14 C

[58] Field of Search ..... 89/1.7, 1.704, 1.705, 89/14 B, 14 C, 14 D

[56] References Cited

U.S. PATENT DOCUMENTS

| | | | |
|---|---|---|---|
| 786,230 | 3/1905 | McClean | 89/14 C |
| 1,290,596 | 1/1919 | Lewis | 89/14 D |
| 2,212,686 | 8/1940 | Hughes | 89/14 C |
| 2,515,180 | 7/1950 | Barker | 89/1.7 |

FOREIGN PATENT DOCUMENTS

| | | | |
|---|---|---|---|
| 389469 | 3/1933 | United Kingdom | 89/14 C |

OTHER PUBLICATIONS

General Information Concerning Patents, Aug. 1979.

*Primary Examiner*—Stephen C. Bentley

[57] ABSTRACT

Muzzle-guard is a regular brake attached to the end of a gun barrel. Powder gasses are led to it in a special way: through openings in the barrel. The flows of the gasses to the brake are steared by the movement of the bullet. Gasses leaving the brake do so coaxially in the form of a widening cone. The muzzle-guard acts like a brake against recoil, lessens the noise and flash of the discharge, also lessens the impact of the gasses on the bullet right after the bullet leaves the barrel, and allows the escape of the compressed air in the front of the bullet. By special ballistics of the ammunition the muzzle-guard according to FIG. 4 makes the recoil almost imperceptible.

2 Claims, 6 Drawing Figures

MUZZLE-GUARD FOR FIREARMS

REFERENCES TO THIS APPLICATION

1. Steam and Gas Turbines . . . by Dr. A. Stodola, N.Y. 1945.
2. Textbook of Small Arms . . . The War Office, London 1929.
3. Engineering Formulas . . . Kurt Gieck, Second Edition, M-c Graw-Hill Book Company, Second American Edition 1976.

SUMMARY OF THE INVENTION

The muzzle-guard is shown in two versions—FIG. 1 and FIG. 4. The first version is a bucket wheel attached at the end of the gun-barrel. As the bullet travels, it opens the holes 3—FIG. 1 that join the inner barrel to the chamber 6—FIG. 1 and to the nozzles 10. The nozzles 10 change the direction of the flow of the powder-gasses and generate a momentum acting against the recoil. Then through stub 7 it leaves the barrel with small coaxial velocity. This arrangement can be used on hand-guns of the proper ballistics. The second version of the muzzle-guard is similar to the first. FIG. 4 shows this muzzle-guard reacting and changing the direction of the gas-flow over $\alpha_4=180°$. Then the gasses leave the rifle through the diffuser-pipes 21—FIG. 4 to the rear of the gunner similar to the action of the military recoilless rifle, and in small amount to the front through stub 14. The gas-flow is steared by the bullet similar to that described in the first version. The muzzle-guard lessens the recoil of the firearm, minimizes the noise and flash, lessens the impact of the gasses on the bullet after it leaves the barrel and removes the dense air compressed in front of the bullet when passing the barrel. In the special ballistics of the ammunition the use of the muzzle-guard according to FIG. 4 makes the recoil almost imperceptible.

The first version is best utilized by civil pocket-guns having appriopriate ballistics, the second version can be used on all types of firearms, as well as on sport guns, civil and military firearms, especially on those having large muzzle-energy and great bullet velocity.

DETAILED DESCRIPTION OF THE INVENTION

Figure 1:
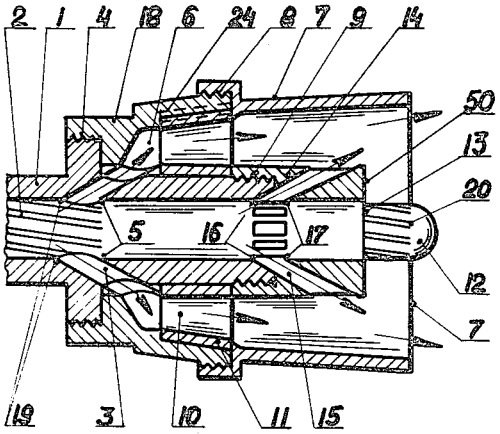
FIG. 1 is a coaxial section of the muzzle-guard mounted on the end of a barrel of a firearm.

FIG. 1 is a coaxial section of the muzzle-guard. At discharge bullet 12 moves through the barrel 1, having twist 2 to edge 5 at openings 3. When the edge 20 of bullet 12 nears edges 19 of openings 3, the compressed air in front of the bullet 12 is forced by this bullet into these openings 3. When the edge 13 of bullet 12 passes edges 19, the powder-gasses are forced through openings 3 into chamber 6 and then into the nozzles 10 on the bucket-wheel 11 in the housing 18. Housing 18 is fastened to the barrel 1 by thread 4, has key 24 which insures wheel 11 against revolving. Wheel 11 is fastened with the help of stub 7 and thread 8 as well as nut 14 and thread 9. Powder gasses flow from the buckets 10 with the small coaxial velocity $v_{o1}$—FIG. 2—to the stub 7. At the same time the edge 13 of the bullet 12 passes the edges 16 in the openings 15 of the nut 14, and the part of the gasses flowing behind bullet 12 moves in these openings 15, is diffused, changes direction and in stub 7 mixes with the gasses flowing from buckets 10. Together they leaves the stub 7 in small coaxial velocity in the form of a widening cone. The distances between the edges 19–5, and 16–17 should be smaller than the distance between the edges 13–20 of the bullet 12.

Figure 2:
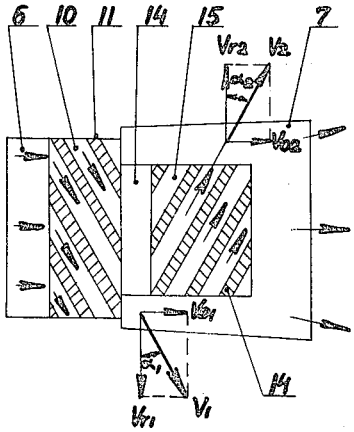
FIG. 2 is a plan of nozzles on the bucket-wheel.

FIG. 2 is a plan of the nozzles of the bucket-wheel 11 and nut 14, suitably arranged at proper angle $\alpha_1$ and $\alpha_2$ so that, gas streams leaving them would be at opposites to each other, and thus minimize the momentum which turns barrel 1—FIG. 1. The stream of gasses flowing from chamber 6 leaves buckets 10 with the velocity $v_1$, small coaxial velocity $v_{o1}$, and rotates around the axle of the barrel 1 with velocity $v_{r1}$. The stream of gasses leaving the nozzles 15 with velocity $v_2$, has the coaxial velocity $v_{o2}$ and rotates with speed $v_{r2}$ in opposite direction. When both streams mix, they leave the stub 7 in the form of a widening cone with small coaxial velocity depending on the angles $\alpha_1$ and $\alpha_2$.

The path of the main gas stream: across opening 3—FIG. 1—, chamber 6, nozzles 1o and stub 7, as well as the path of the stream created across nozzles 15 are notable longer than the path of bullet 12 from edges 19 to the edge 50. In addition, gasses flow out in the form of cone around the axis of the barrel 1—FIG. 1—. Because of this, the gasses cannot effect the movement of bullet 12 when its velocity is not too small.

Figure 3:
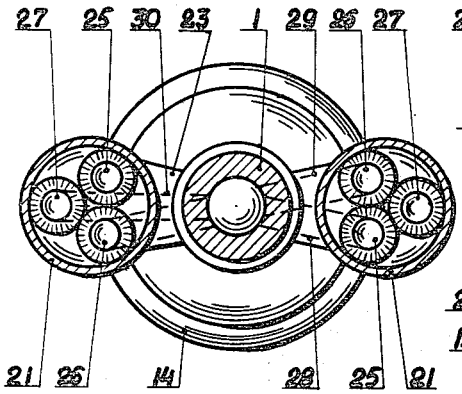
FIG. 3 shows a cross-section of a barrel of a firearm with the muzzle-guard mounted at the end.

FIG. 3 is a cross-section of a rifle barrel with muzzle-guard attached at its end. On the barrel 1 is mounted housing 23 of muzzle-guard from which, fanned out radially, are 3 pairs of nozzles 25, 26 and 27. They have openings: 28 for nozzles 25, openings 29 for nozzles 26 and openings 30 for nozzles 27. The openings join the nozzles to the inner of the barrel and are placed at a small angle $\alpha_3$—FIG. 4—to the barrel axis. Symmetrically and evenly placed from the axis of the barrel nozzles 25, 26 and 27 are bent in an angle $\alpha_4=180°$/FIG. 4/from the direction of the barrel axis.

Figure 4:
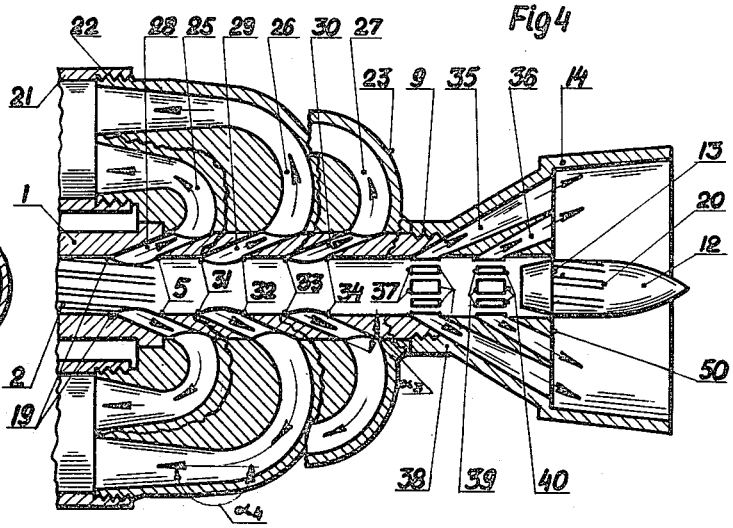
FIG. 4 shows a coaxial section of the muzzle-guard attached at the end of a gun barrel from FIG. 3.

FIG. 4 shows muzzle-guard attached at the end of a rifle of large caliber and larger amount of gun powder This figure is a coaxial section. After discharge bullet 12 moves along barrel 1 having rifling 2. When edge 20 of bullet 12 nears edges 19 of openings 28, the air, pressured by the bullet 12, flows into openings 28. Further, the edge 13 of bullet 12 passes edges 19 and powder gasses with great force flow across the openings 28, and bent 180° nozzles 25 and reach maximum speed and flow into diffuser-pipes 21 which are symmetrically and exactly placed from the axis of barrel 1. Because the edge 20 of bullet 12 already passes the edges 5 of openings 28, the gasses cannot get in front of bullet 12. This effect will repeat exactly the same way when edge 13 of bullet 12 will be passing edges 31, 33, 37 and 39 of openings 29, 30, 35 and 36. Gasses will flow also over openings 29 and 30 and over the bent nozzles 26 and 27 to diffuser-pipes 21 also over nozzles 35 and 36 to stub 14. The distances between edges 19–5, 31–32, 33–34, 37–38, and 39–40 must be smaller each than the lengths between edges 13–20 of bullet 12. Housing 23 of muzzle-guard is attached on the gun barrel by a stub 14 and thread 9. Stub 14 contains nozzles 35 and 36 to the edge 50. To the housing 23 attached two pipe-diffusers 21 by means of threads 22.

Figure 5:
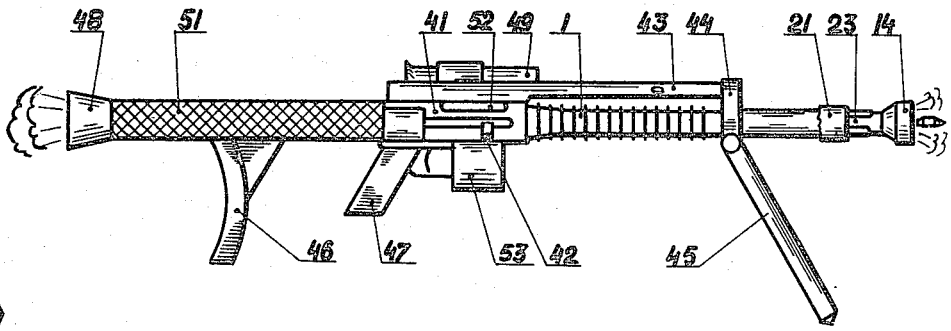
FIG. 5 is a view of a rifle.

FIG. 5 shows the placement of the individual mechanisms in rifle having a muzzle-guard. Barrel 1 is strongly ribbed and has housing 23 of muzzle-guard attached, and also the stub 14. Two diffuser-pipes 21 lead the powder gasses to the rear. Diffusers 48 are placed at the ends of the pipes 21. A certain length of the pipes 21 are equipped with insulation 51 against the passage of heat to the direction of the gunner. Gas cylinder and slide housing 43 are placed on the upper part of the barrel and with the help of gas block 44 to which is connected a bipod 45. Opening 52 which ejects the spent shells is located at the top part of receiver 41. The bolt handle 42 is located under pipe 21. At the bottom of the receiver is placed clip 53 and firing grip 47. Shoulder butt 46 is attached to the receiver or to the pipes 21. At the moment of firing, the openings of diffusers 48 must naturally be behind the shoulder of the gunner. Thus the outline of the guns equipped with the muzzle-guard is similar to the regular construction of the firearms.

Figure 6:
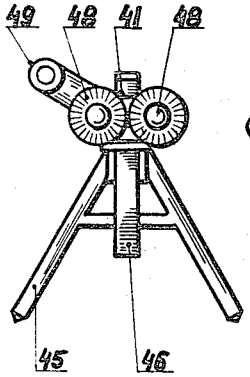
FIG. 6 is a view of a rifle from FIG. 5.

FIG. 6 is a view of the rifle from FIG. 5. End-diffusers 48 are attached to the ends of pipes 21. This entire arrangement must be placed symmetrically on the barrel. Shoulder butt 46 and bipod 45 are on the lower part of the gun under the receiver. Optic sight 49 is attached to the side of the receiver 41.

SUMMARY

The muzzle-guard:

lessens the recoil of firearms, lessens the noise and flash, eliminates the disturbances of the bullet, minimizing the turbulence of the powder gasses as they move with greater velocity, according FIG. 1 allows the escape of gasses only to the front in the form of a widening cone and only coaxially; made according to FIG. 4 leads the main stream of gasses to the rear and leads only a small amount of gasses to the front, it allows the escape of the compressed air in the front of the bullet, before the bullet leaves the muzzle. Muzzle-guard have small dimensions and can be used even with small pocket guns, but the quotient (weight of powder)/(weight of bullet) must be adequate. Therefore, their use is limited to very high velocities; that means that regular cases must be used with quick-burning powders and light bullets. Thus the recoil lessens for two reasons: the reducing of the weight of the bullet and action of the muzzle-guard. The reaction of the bullets on live targets, through the great momentum results in "explosive wounds and paralyzing effects". In small fire-arms it is possible to use 0.50 cal machine gun cases and 20 mm cannon cases. Reducing the weight of the bullets an appriopriate; two and four times, we obtain the muzzle velocity $v_0$=1500 and 1400 yards/sec by regular pressure, and some lessening of the recoil. With use of the muzzle-guard according to FIG. 4 the recoil becomes almost imperceptible. Substituting a "bunch of steel buck shot", or a "bunch of self-stabilizing needles" or a "bunch of arrows" or anti-armor piercings for conventional single bullets, it is possible to hit targets more easily even for unskilled persons, at greater distances than formerly.

ADDENDUM

1. According to /2/—page 351 momentum of recoil is given by the formula:

$$M_r=(W+kw)v$$

$M_r$=momentum
W=bullet weight
w=charge weight
v=muzzle velocity

Average value of k is k=1,5 for rifles. by use of muzzle-guard the powder gasses cannot expand behind the muzzle for a rifle to the velocity of about 2200 yards/-sec, thus the value of "k" can be dimished to 1,0 or less. By big value of "w" this fact is very important.

2. The powder gasses expanding behind the muzzle of the barrel of firearm disturb the flow of the bullet. The lighter the bullet—the bigger is the disturbance. Using muzzle-guard it doesn't occur.

3. According to /1/, volume 1, page 210 the axial pressure in any turbine system (rotating wheel) is:

$$P_a=f_{1a}\cdot p_1-f_{2a}\cdot p_2-M(c_{2a}-c_{1a})$$

$P_a$=reaction parallel to the axis of turbine,
M=mass of gas,
$f_{1a}$, $f_{2a}$=projection of the entrance and exit surfaces upon a plane at right angles to the axis,
$c_{1a}$, $c_{2a}$=velocities parallel to the axis,
$p_1$, $p_2$=pressures at entrance and exit of the wheel or turbine (a) Muzzle-guard according to FIG. 1 and FIG. 2:

$f_{1a}$, $f_{2a}$=projection of the entrance and exit surfaces of the nozzles are small,
$c_{1a}$=about $v_o$
$c_{2a}=v_o\cdot\sin\alpha_1$
$p_1$ is big, $p_2$ is small. Omitting the products $f_{1a}\,p_1-f_{2a}p_2$, is $$P_a=M\cdot v_o(1-\sin\alpha_1)$$

Hence $P_a$ counteracting to the recoil is small and practically balances only the reaction from the powder gasses itself.

(b) Muzzle-guard according to FIG. 4:

$$c_{1a}=\text{about } v_o\cdot\cos\alpha_3$$

$$c_{2a}=c_{max}\cdot\cos\alpha_4$$

Omitting the products $f_{1a}\cdot p_1-f_{2a}\cdot p_2$, and given:
$\cos\alpha_3$=about 1 . . . because $\alpha_3$ is small angle,
$\cos\alpha_4=\cos 180°=-1$ . . . according to /3/, table E2, point e 10,
and we obtain: ti $P_a=M(v_o+c_{max})$ The product: $M\cdot v_o$ counteracts to the recoil from the powder itself, the second product: $M\cdot c_{max}$ counteracts to the momentum of recoil of the bullet.

When $c_{max}$=6600 f/sec and velocity of the bullet is $v_o$=about 4900 f/sec, can be found, that:

$$\frac{\text{weight of powder}}{\text{weight of bullet}}=\frac{0,75}{1,0}$$

or by $v_o$=3300 f/sec the above quotient is (0,5)/(1,0)

and that $P_a$ balances totally the momentum of recoil of the gun.

4. In point 3*b* the momentum of recoil is 0 but the rifle does not remain motionless because when the bullet passes the barrel, the rifle moves to the back of path:

$$\text{path} = \frac{(\text{mass of bullet} + \text{mass of powder})}{\text{mass of rifle}} \cdot \text{length of barrel}$$

This move follows under the full power of recoil and is acting on the shooter. To release the shooter from this physiologically very unpleasant occurence there must be used: "anti-recoil arrangement" according to the patent application 06/065.113.

We claim:

1. A firearm for firing cartridges comprising a receiver having a breech-end, a barrel having a muzzle attached to said receiver at said breech-end, and a muzzle-guard attached at the muzzle of said barrel;

said muzzle-guard comprising a first housing fitted at said muzzle, said first housing being a single, threaded nut fitted onto said muzzle, said nut having nozzles connected to the inside of said barrel by a first set of openings;

a second housing comprising at least one gas expansion nozzle and at least one insulated diffuser-pipe connected thereto, a second set of openings connected to the inside of said barrel at said muzzle, said at least one insulated diffuser-pipe leading gasses produced by firing a cartridge from said second set of openings above the shoulder of a gunner to said at least one gas expansion nozzle, said second set of openings leading to nozzles in said second housing which bend 180° to the axis of said barrel and lead a major portion of the gasses produced by firing a cartridge to the rear to said at least one insulated diffuser-pipe thence towards the gunner and above the shoulder thereof with only a much smaller portion of said gasses passing through said first set of openings thence to said muzzle-guard.

2. A firearm for firing cartridges comprising a receiver having a breech-end, a barrel attached to said receiver at said breech-end, a stock and a muzzle-guard attached at the muzzle of said barrel, said muzzle-guard having a housing fitted at said muzzle, a bucket-wheel having nozzles connected to the inside of said barrel by way of openings and set inside said housing, a threaded short-length stub having a shape of a greatly widening cone in the form of a funnel and connected to said housing, a nut having nozzles connected to the inside of said barrel by way of openings, whereby after discharge in said firearm the powder gasses flowing through all said openings and nozzles, said nozzles twisted to the right in said bucket-wheel and twisted to the left in said nut, expand, and changing their coaxial direction rotate with small coaxial speed according to the spiral lines around the axis of said barrel, and after passing the edge of said stub-according to the tangent lines:

lessening the recoil, allowing compressed air in the front of the bullet to escape before the bullet leaves said muzzle, lessening the muzzle-flash and muzzle-blast, lessening the impact of powder-gasses on said bullet after it leaves the muzzle, leaving the firing rate of said firearm unchanged.

* * * * *